US006644493B1

(12) United States Patent
Walton et al.

(10) Patent No.: US 6,644,493 B1
(45) Date of Patent: Nov. 11, 2003

(54) WEIGHTED GARBAGE CAN WITH LEGS

(76) Inventors: Sandra T. Walton, 27 Precourt La., Norton, MA (US) 22766; Rasheed S. Walton, 9001 NW. 6th Ct., Plantation, FL (US) 33324

( * ) Notice: Subject to any disclaimer, the term of this patent is extended or adjusted under 35 U.S.C. 154(b) by 0 days.

(21) Appl. No.: 10/429,045

(22) Filed: May 5, 2003

Related U.S. Application Data

(60) Provisional application No. 60/447,763, filed on Feb. 19, 2003.

(51) Int. Cl.[7] ..... B65D 6/28

(52) U.S. Cl. ..... 220/603; 220/629; 220/631; 220/908

(58) Field of Search ..... 220/603, 629, 220/630, 631, 633, 636, 637, 908

(56) References Cited

U.S. PATENT DOCUMENTS 2,601,767 A * 7/1952 Wall ..... 220/719
2,937,872 A 5/1960 Gilman
4,475,101 A * 10/1984 Kulp et al. ..... 340/908.1
4,872,582 A 10/1989 Sipple
4,905,945 A 3/1990 Peterson
5,125,526 A * 6/1992 Sumanis ..... 220/263
5,419,453 A * 5/1995 Lochridge ..... 220/495.06
5,690,247 A * 11/1997 Boover ..... 220/495.11
6,168,034 B1 1/2001 Perrone
6,328,320 B1 * 12/2001 Walski et al. ..... 280/47.26
6,508,377 B1 * 1/2003 Griswold et al. ..... 220/495.06

* cited by examiner

*Primary Examiner*—Joseph M. Moy
(74) *Attorney, Agent, or Firm*—Richard C. Litman

(57) ABSTRACT

The weighted garbage can with legs has a receptacle with a rounded weighted base such that the empty garbage can will tend to remain upright and will upright itself if tipped. The weighted garbage can with legs also has retractable legs that function in conjunction with a spring suspended inner platform to retract when the garbage can is empty and extend as the receptacle is filled. The legs extend as the receptacle is filled to stabilize the can as the self-uprighting tendency is overcome when the filled receptacle becomes top-heavy.

11 Claims, 6 Drawing Sheets

WEIGHTED GARBAGE CAN WITH LEGS

CROSS-REFERENCE TO RELATED APPLICATION

This application claims the benefit of U.S. Provisional Patent Application Ser. No. 60/447,763, filed Feb. 19, 2003.

BACKGROUND OF THE INVENTION

1. Field of the Invention

The present invention relates to garbage cans, and more particularly, to a weighted garbage can with legs having a weighted bottom to maintain the garbage can in an upright position when empty, and retractable, spring-based legs which extend through the weighted platform in order to maintain the garbage can in an upright position when filled with trash.

2. Description of related Art

Garbage cans have appeared in countless shapes and sizes, and are seen in use in homes, offices, and public areas. Perhaps most familiar are the garbage cans used at residential homes and dragged ritually to the curbside for pickup. Such garbage cans are typically a generally cylindrical or rectangular container having a flat bottom. Often, wheels affixed to the bottom assist in moving a heavy, filled can.

A common problem with garbage cans is that they may be tipped over. Especially prone to tipping are the residential trash cans left outdoors or at curbside where they are vulnerable to wind, animals, or uneven ground, causing them to tip. Once tipped, the garbage can may spill its contents, or even roll away or be blown away by wind. Additionally a can may be blown into the road presenting a hazard to car traffic. The result is spilled garbage to clean up, a lost garbage can to be replaced, or worse, a traffic accident.

One solution to the problem of tipping garbage cans is to add weight to the can. U.S. Pat. No. 4,872,582, issued Oct. 10, 1989 to G. L. Sipple, shows a weighted refuse container having a weighted bottom. The container is formed with a compartment within a false floor of the container. A threaded, removable plug allows the compartment to be filled with water to weight the container for stability. The weighted bottom of this container will add stability. However, if the container is tipped, as by a large animal or a strong wind, the container will not upright itself.

Another method to stabilize a garbage can against tipping is shown in U.S. Pat. No. 4,905,945, issued Mar. 6, 1990 to D. Peterson. The garbage can is stabilized by placing it into a weighted base. The weighted, stabilizing base is a molded concrete ring. In use, the garbage can is placed into the concrete ring and stabilized by the walls of the concrete ring. While providing stability to the garbage can, this approach requires that the can is lifted into, and out from, the weighted base. Additionally, the can will not be self-uprighted or otherwise stabilized in the event it is knocked from the base, such as by a large animal. This method for stabilizing a garbage can is further inconvenienced because the stabilizing base is separate from the garbage receptacle.

Various vertically standing articles have been stabilized or made to be self-uprighting by the addition of a round or spherically shaped weighted bottom. U.S. Pat. No. 6,168,034, issued Jan. 2, 2001 to Perrone shows a self-righting bottle. U.S. Pat. No. 2,937,872 shows a self-erecting football dummy. Both of these devices fail to address the need inherent to garbage cans for stabilizing a vertically standing container that may become filled with potentially heavy contents and which may become too top heavy to upright itself. In the case of the self-righting bottle, the weight required to make a baby formula feeding bottle self-uprighting is not excessive, even in light of a bottle full of formula, to make use of the bottle impractical. In the case of the football dummy, it is simply not intended that the dummy be of significant weight to render it non-functionally top heavy.

None of the above inventions and patents, taken either singly or in combination, is seen to describe the instant invention as claimed.

SUMMARY OF THE INVENTION

The weighted garbage can with legs is a garbage can that will resist being overturned, and will right itself if tipped. The garbage can has a rounded, weighted base that causes the empty can to upright itself when tipped. Legs are attached to an internal, spring supported, platform and extend through holes in the bottom of the can so that as the can is filled, the weight is borne by the legs instead of the rounded bottom. The legs, which extend to contact the ground when the platform is weighted, stabilize the garbage can when the can is filled.

Accordingly, it is a principal object of the invention to provide a garbage can that will reduce the inconvenience and risk of loss associated with the tipping over of garbage cans by incorporating a self-uprighting feature along with stabilizing legs.

It is another object of the invention to provide a garbage can that incorporates a weighted bottom to provide stability and a self-uprighting feature.

It is a further object of the invention to provide a garbage can that incorporates a weight-activated leg system to add increased stability as garbage is added into the can.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
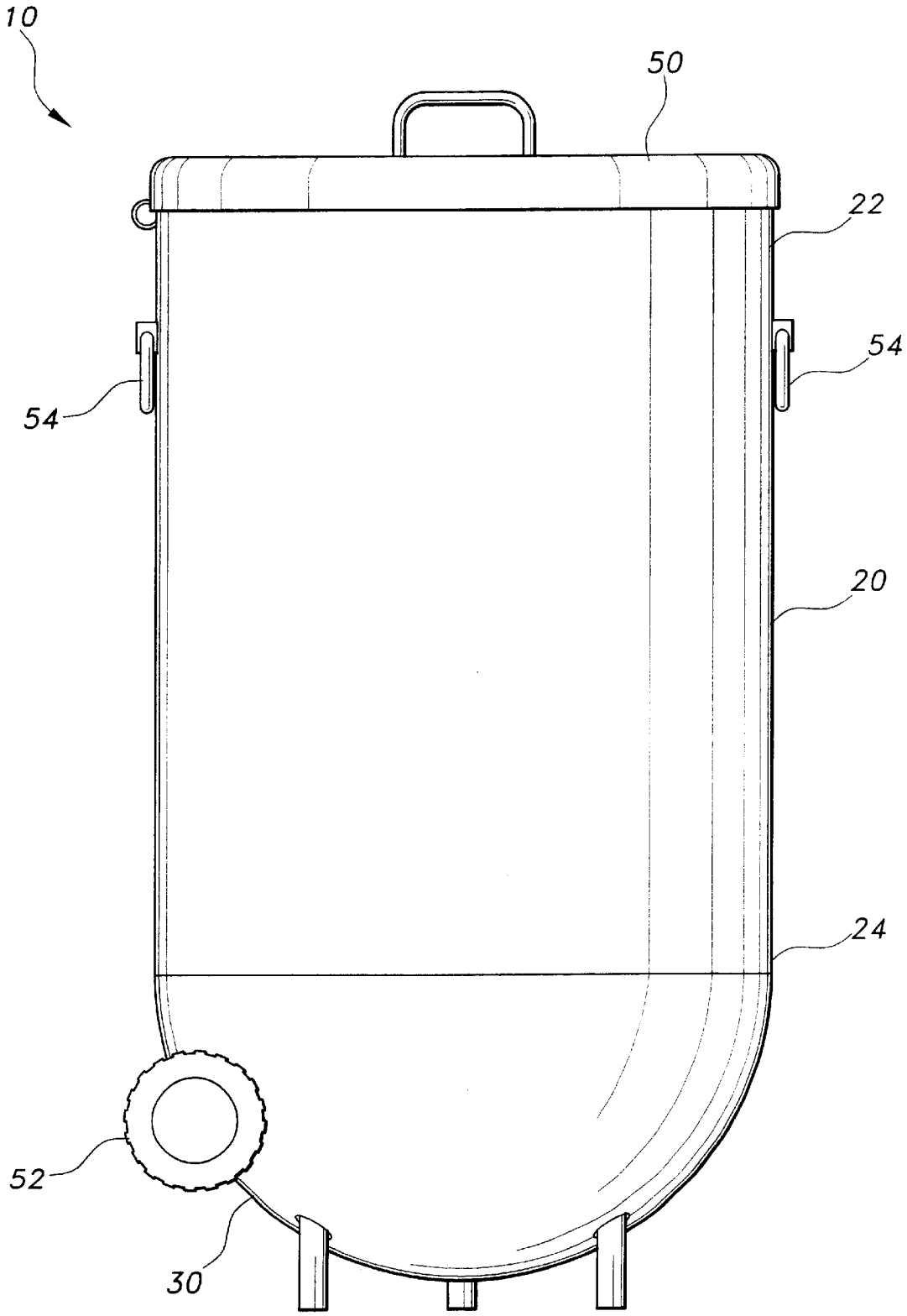
FIG. 1 is an elevation view of a weighted garbage can with legs according to the present invention.
Figure 2:
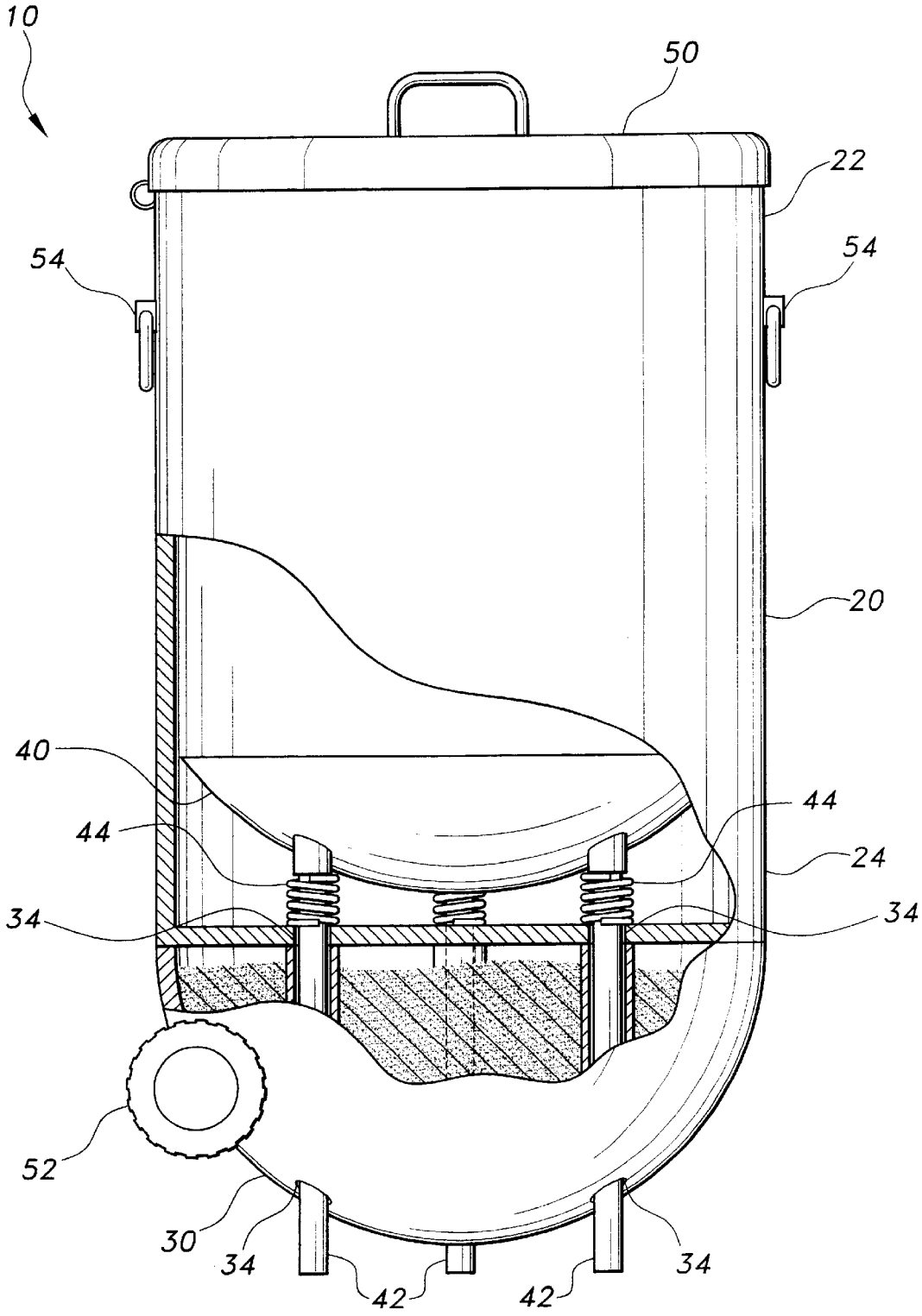
FIG. 2 is an elevation view of the garbage can according to the present invention, partly in section to show the weight controlled platform and retractable legs, with the legs in an extended position.
Figure 3:
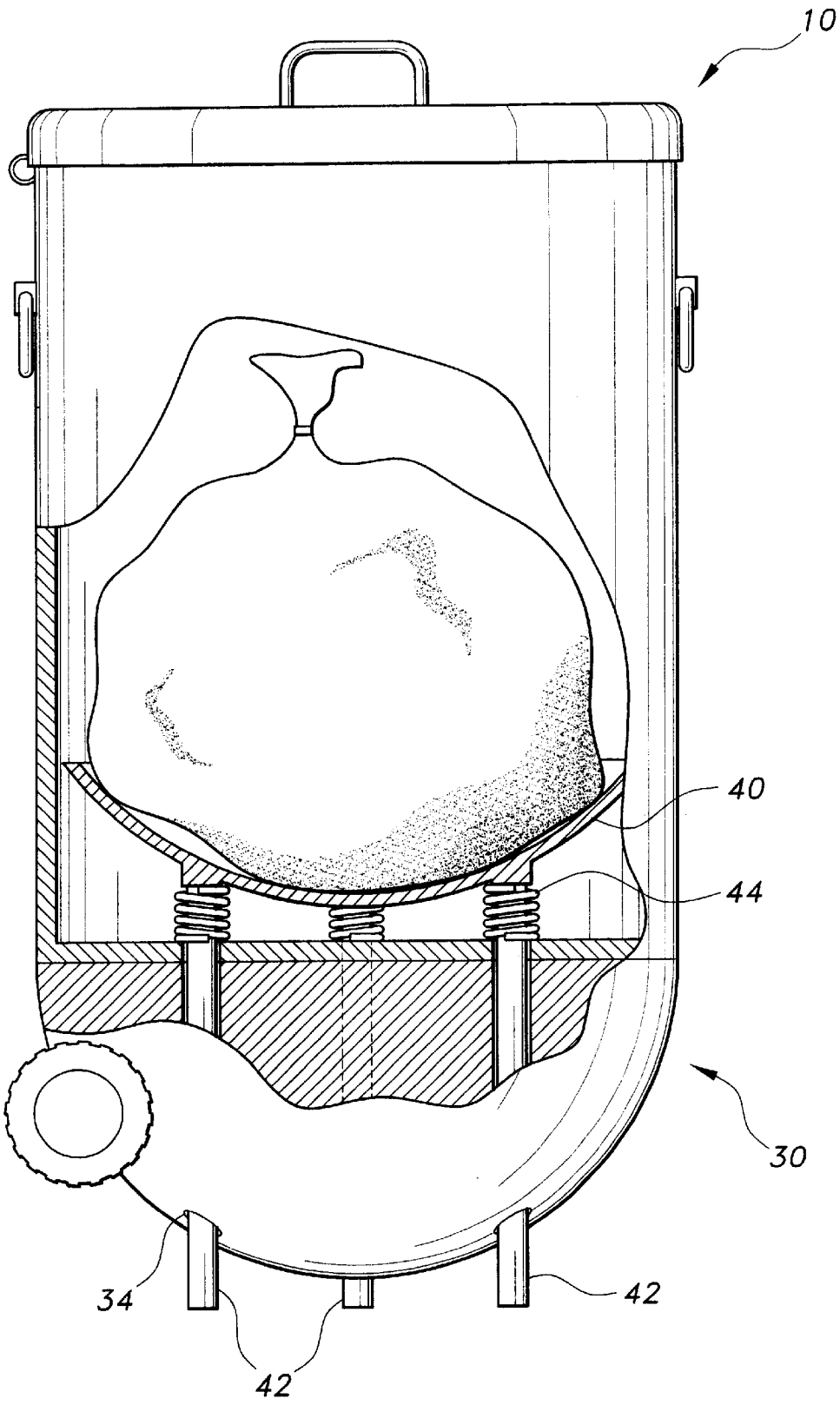
FIG. 3 is an environmental view similar to FIG. 2 with a weighty disposed on the weight-controlled platform.
Figure 4:
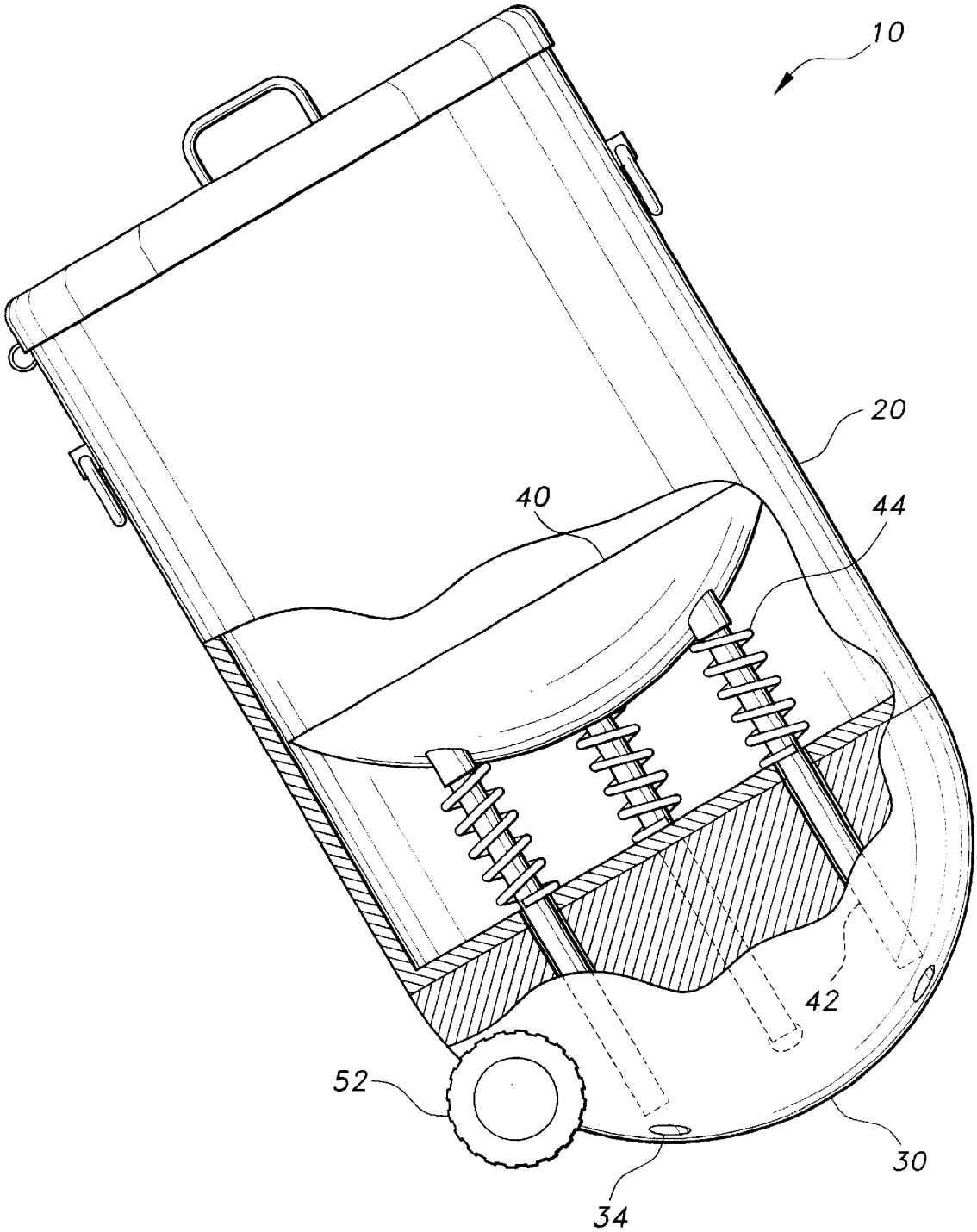
FIG. 4 is an elevation view of the garbage can, partly in section, with the weight-controlled platform unweighted to retract the legs and with the can tilted for transport.
Figure 6:
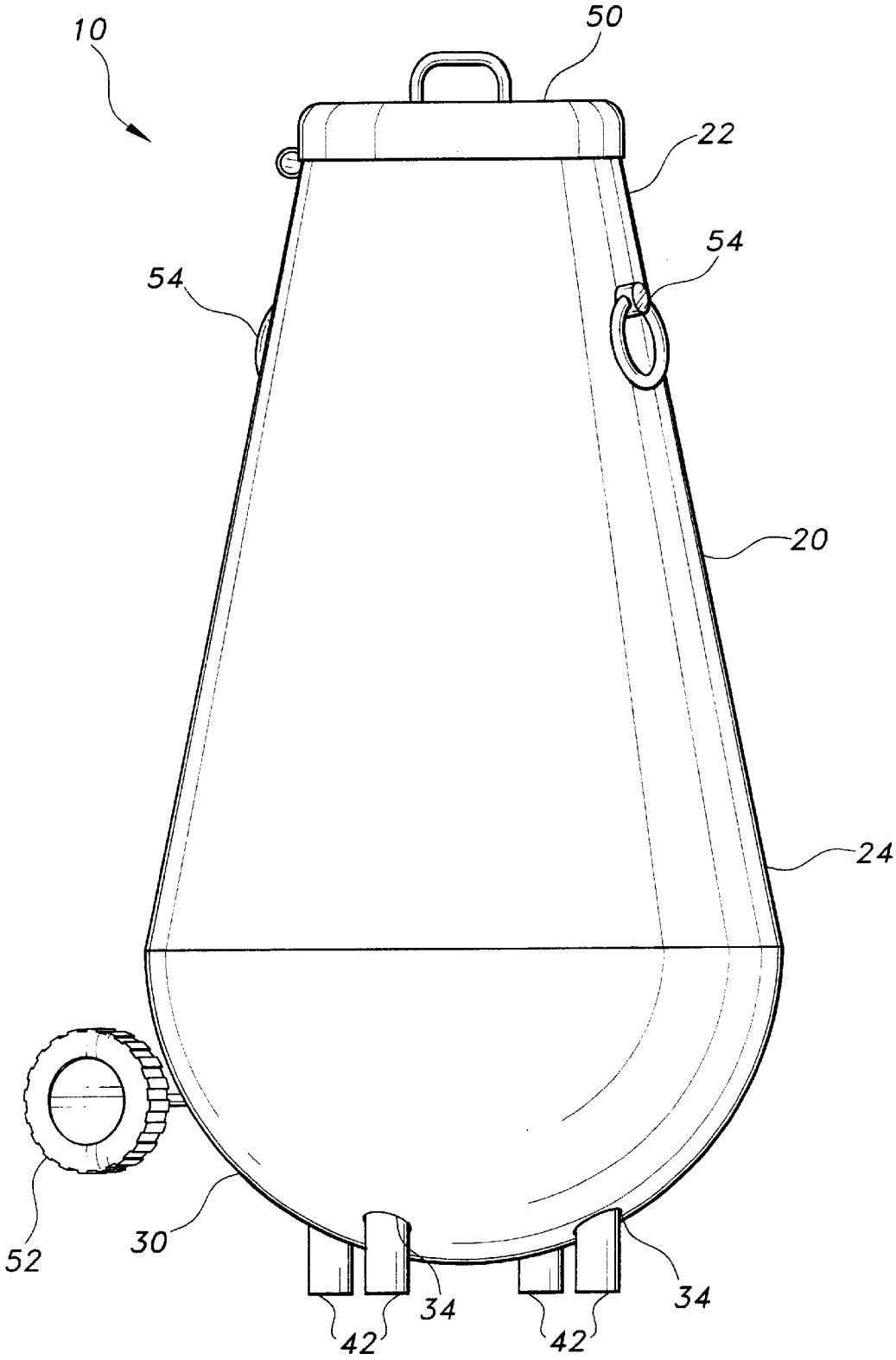
FIG. 6 is an environmental perspective view showing the garbage can with a conically shaped receptacle portion, and having four legs.

The present invention is a weighted garbage can with legs designated generally as 10 in the drawings. The weighted garbage can with legs 10, as shown in FIGS. 1–2, has a receptacle portion 20 that is shown in the drawings as a hollow, walled, cylindrical compartment having a bottom wall, although the receptacle portion 20 may be generally round, rectangular, or any one of a number of shapes that are commonly known in garbage cans. FIG. 6 shows the garbage can 10 having a receptacle portion 20 that is conical in shape, with upper end 22 narrower than lower end 24 for added stability. The receptacle portion 20 has an upper end 22 for receiving garbage and a lower end 24. A weighted bottom 30 is affixed to the lower end 24 of the receptacle portion 20. The weighted bottom 30 may be integral with or define the bottom wall of the receptacle portion 20, or may be attached to the bottom wall of the receptacle portion 20. As shown in FIGS. 2–4, a platform 40 is disposed within the lower end 24 of the receptacle 20, above the weighted bottom 30. A plurality of legs 42 are attached to the platform 40. The legs 42 are in alignment with holes 34 through the weighted bottom 30 such that the legs 42 may be extended through the holes 34 to protrude below the weighted bottom 30 and come into contact with the ground. The platform 40 is suspended above the weighted bottom 30 with helical compression springs 44 concentrically mounted on legs 42 so that when the platform 40 is not weighted, the platform 40 is lifted by the springs 44 in order to retract the legs 42 so that they do not protrude from the weighted bottom 30. When the platform 40 is weighted, as by garbage discarded into the garbage can 10, the springs 44 are compressed by the weight so that the legs 42 are extended through the holes 34, protruding below the weighted bottom 30 to contact the ground. When the legs 42 are so extended, the weight of the contents of the garbage can 10 is supported by the legs 42 and the platform 40. As seen most clearly in FIGS. 3–4, the springs 44 may be coiled around the legs 42 between the. platform 40 and the weighted bottom 30 to uniformly provide spring suspension of the platform 40.

Figure 5:
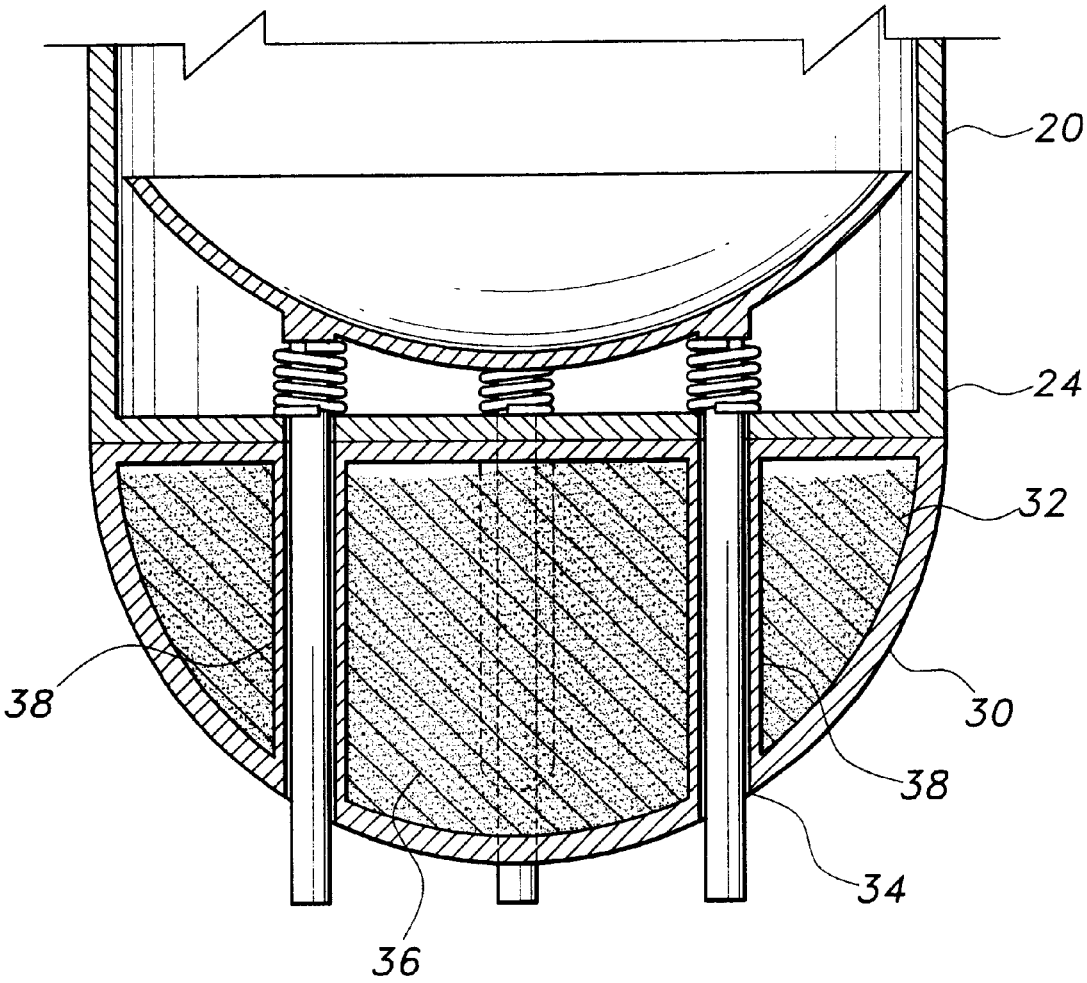
FIG. 5 is a fragmented cross-sectional view of a hollow, sand-filled embodiment of the weighted bottom.

The weighted bottom 30 provides the self-uprighting feature of the garbage can 10. The weighted bottom 30 has a convex, rounded shape, and may be solidly formed with a center of mass on a central vertical axis through the receptacle portion 20 and weighted bottom 30, as seen in FIGS. 3–4, or formed with a hollow interior 32 containing a filler material 36, such as sand, concrete, or water such that the radius of curvature causes the aggregate material to return to a position balanced around a central vertical axis through the receptacle portion 20 and weighted portion. In the embodiment of the weighted bottom 30 formed with a hollow interior 32, detailed in FIG. 5, tubular members 38 extend through the hollow interior 32 to define walls of the holes 34 extending through the weighted bottom 30.

The weight of the weighted bottom 30 must be sufficient, in relation to the receptacle portion 20 of the can, so that the trash can will resist tipping and, if tipped, will upright itself.

As shown in FIGS. 1 and 4, the garbage can with legs 10 has a lid 50 to cover the open upper end of the receptacle portion 20, a pair of handles 54 disposed on diametrically opposite sides of the receptacle portion 20, and a pair of wheels 52 (only one wheel 52 shown in the drawings, the other wheel being symmetrically disposed on the side of the garbage can hidden from view) disposed on one side of the weighted bottom 30. The garbage can 10 may be grasped by the handles 54 and tilted when empty, as shown in FIG. 4, for easy transport to any desired location. The garbage can may also be lifted by grasping the handles 54 for transport, whether empty or full.

It is to be understood that the present invention is not limited to the sole embodiment described above, but encompasses any and all embodiments within the scope of the following claims.

We claim:

1. A garbage can with legs, comprising:

(a) a receptacle portion having upper and lower ends;

(b) a convex, rounded, weighted bottom attached to the lower end of said receptacle portion, said weighted bottom having a plurality of vertical holes therethrough;

(c) a platform disposed within said lower end of said receptacle portion above said weighted bottom;

(d) a plurality of vertical legs attached to and depending from said platform, the legs being in alignment with said vertical holes in said weighted bottom; and (e) bias means for retracting said legs within said weighted bottom when said receptacle portion is empty, and said legs extending through the holes when a weight is placed on said platform so that said platform is supported by said legs;

wherein said weighted bottom has a center of mass positioned so that said receptacle portion returns to a vertical position when the garbage can is tipped while empty.

2. The garbage can with legs according to claim 1, wherein said bias means comprises a helically wound compression spring concentrically disposed around each said leg between said platform and said weighted bottom.

3. The garbage can with legs according to claim 1, wherein said weighted bottom comprises a solid body attached to the lower end of said receptacle portion.

4. The garbage can with legs according to claim 1, wherein said weighted bottom comprises:

a hollow body attached to the lower end of said receptacle portion; and an aggregate material disposed within said hollow body.

5. The garbage can with legs according to claim 4, wherein said aggregate material comprises sand.

6. The garbage can with legs according to claim 4, wherein said aggregate material comprises concrete.

7. The garbage can with legs according to claim 4, wherein said aggregate material comprises water.

8. The garbage can with legs according to claim 1, further comprising a lid disposed on the upper end of the receptacle portion.

9. The garbage can with legs according to claim 1, further comprising a pair of handles disposed on opposite sides of said receptacle portion.

10. The garbage can with legs according to claim 1, further comprising a pair of wheels disposed on one side of said weighted bottom, whereby the garbage can may be tilted onto said wheels and rolled for easy transport.

11. The garbage can with legs according to claim 1, wherein the upper end of said receptacle portion is narrower than the lower end of said receptacle portion, said receptacle portion defining a conical shape.

* * * * *